US010824098B2

(12) United States Patent
Yamazaki

(10) Patent No.: US 10,824,098 B2
(45) Date of Patent: Nov. 3, 2020

(54) IMAGE FORMING APPARATUS

(71) Applicant: FUJI XEROX CO., LTD., Tokyo (JP)

(72) Inventor: Hiroki Yamazaki, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 0 days.

(21) Appl. No.: 16/292,347

(22) Filed: Mar. 5, 2019

(65) Prior Publication Data

US 2020/0026226 A1 Jan. 23, 2020

(30) Foreign Application Priority Data

Jul. 23, 2018 (JP) ..... 2018-137732

(51) Int. Cl.
*G03G 15/20* (2006.01)
*G03G 13/20* (2006.01)
*G03G 21/00* (2006.01)

(52) U.S. Cl.
CPC ..... *G03G 15/2039* (2013.01); *G03G 13/20* (2013.01); *G03G 21/0052* (2013.01)

(58) Field of Classification Search
CPC . G03G 15/2039; G03G 13/20; G03G 21/0052
See application file for complete search history.

(56) References Cited

U.S. PATENT DOCUMENTS

2014/0161481 A1* 6/2014 Udagawa ..... G03G 21/206 399/92

FOREIGN PATENT DOCUMENTS

JP 2017134103 8/2017

* cited by examiner

*Primary Examiner* — Clayton E. LaBalle
*Assistant Examiner* — Michael A Harrison
(74) *Attorney, Agent, or Firm* — JCIPRNET

(57) ABSTRACT

An image forming apparatus includes a fixing device that fixes an image to a recording medium that is transported by applying heat; a guide member including a first guide surface that guides the recording medium to which the image has been fixed by the fixing device, a second guide surface that is opposite to the first guide surface and that guides the recording medium that is transported backward after being guided by the first guide surface, and a communicating portion that enables air to flow between the first guide surface and the second guide surface; and plural suction members that cool the recording medium guided by the first guide surface by sucking air in a direction toward the second guide surface of the guide member, the suction members being arranged in a transporting direction in which the recording medium is transported.

7 Claims, 9 Drawing Sheets

IMAGE FORMING APPARATUS

CROSS-REFERENCE TO RELATED APPLICATIONS

This application is based on and claims priority under 35 USC 119 from Japanese Patent Application No. 2018-137732 filed Jul. 23, 2018.

BACKGROUND

(i) Technical Field

The present disclosure relates to an image forming apparatus.

(ii) Related Art

An image forming apparatus described in Japanese Unexamined Patent Application Publication No. 2017-134103 includes a fixing unit that fixes toner to a paper sheet; a curved portion of a double-sided-printing transport path that is provided downstream of the fixing unit in a transporting direction in which the paper sheet is transported, the curved portion being curved with respect to the transporting direction; a duct that has inlets, that is disposed radially outside the curved portion of the double-sided printing transport path, and that extends in a width direction of the paper sheet that crosses the transporting direction; and two fans that are provided adjacent to the inlets in the duct to generate airflow in the duct and that are arranged in the width direction of the paper sheet such that suction sides thereof face the fixing unit.

Summary

A guide member that guides a recording medium along a transport path is provided downstream of a fixing device in a transporting direction in which the recording medium is transported. For example, when viewed in a width direction of the recording medium, the guide member has a first guide surface at one side and a second guide surface at the other side. The first guide surface guides the recording medium along the transport path. The second guide surface guides the recording medium along a reversing path used to perform double-sided printing.

Cooling fans are provided to cool the recording medium guided by the first guide surface of the guide member by suction in a direction toward the second guide surface. The cooling fans are aligned in the width direction of the recording medium in a single row in the transporting direction of the recording medium.

When a recording medium guided by the second guide surface is transported between a recording medium that is being guided by the first guide surface and the cooling fans, the suction force applied by the cooling fans (suction members) to the recording medium that is being guided by the first guide surface is reduced. Therefore, there is a risk that the recording medium will not be sufficiently cooled.

Aspects of non-limiting embodiments of the present disclosure relate to a technology for cooling a transported recording medium over a longer range in a transporting direction in which the recording medium is transported than when suction members are aligned in a single row in the transporting direction of the recording medium.

Aspects of certain non-limiting embodiments of the present disclosure overcome the above disadvantages and/or other disadvantages not described above. However, aspects of the non-limiting embodiments are not required to overcome the disadvantages described above, and aspects of the non-limiting embodiments of the present disclosure may not overcome any of the disadvantages described above.

According to an aspect of the present disclosure, there is provided an image forming apparatus including a fixing device that fixes an image to a recording medium that is transported by applying heat; a guide member including a first guide surface that guides the recording medium to which the image has been fixed by the fixing device, a second guide surface that is opposite to the first guide surface and that guides the recording medium that is transported backward after being guided by the first guide surface, and a communicating portion that enables air to flow between the first guide surface and the second guide surface; and plural suction members that cool the recording medium guided by the first guide surface by sucking air in a direction toward the second guide surface of the guide member, the suction members being arranged in a transporting direction in which the recording medium is transported.

BRIEF DESCRIPTION OF THE DRAWINGS

Exemplary embodiments of the present disclosure will be described in detail based on the following figures, wherein.

DETAILED DESCRIPTION

First Exemplary Embodiment

Figure 1:
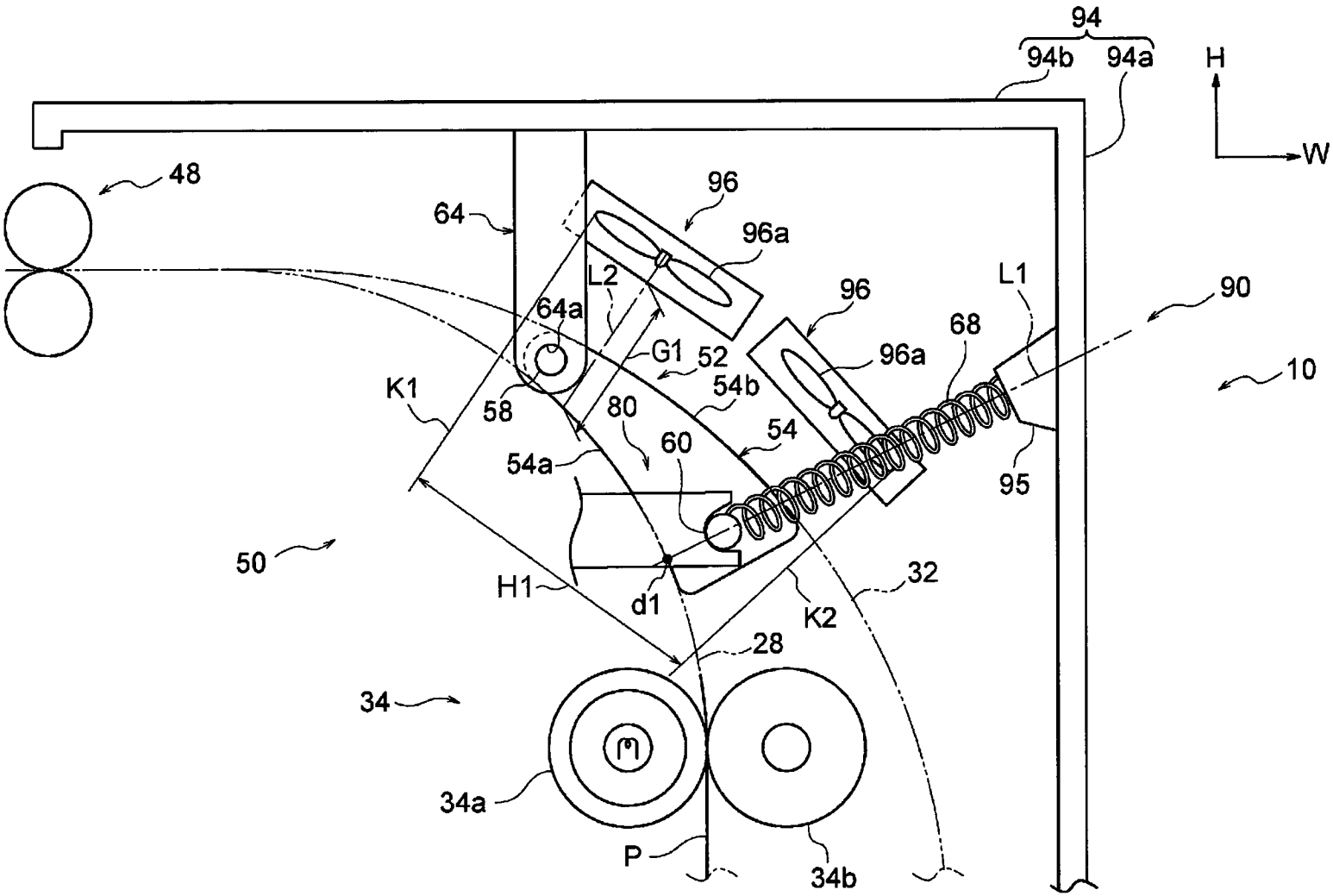
FIG. 1 is a side view illustrating a guide member, cooling fans, and other members included in an image forming apparatus according to a first exemplary embodiment of the present disclosure when an opening-closing door is closed.

An example of an image forming apparatus according to a first exemplary embodiment of the present disclosure will be described with reference to FIGS. 1 to 8. In the drawings, arrow H indicates an apparatus up-down direction (vertical direction), arrow W an apparatus width direction (horizontal direction), and arrow D an apparatus depth direction (horizontal direction).

Overall Structure

Figure 7:
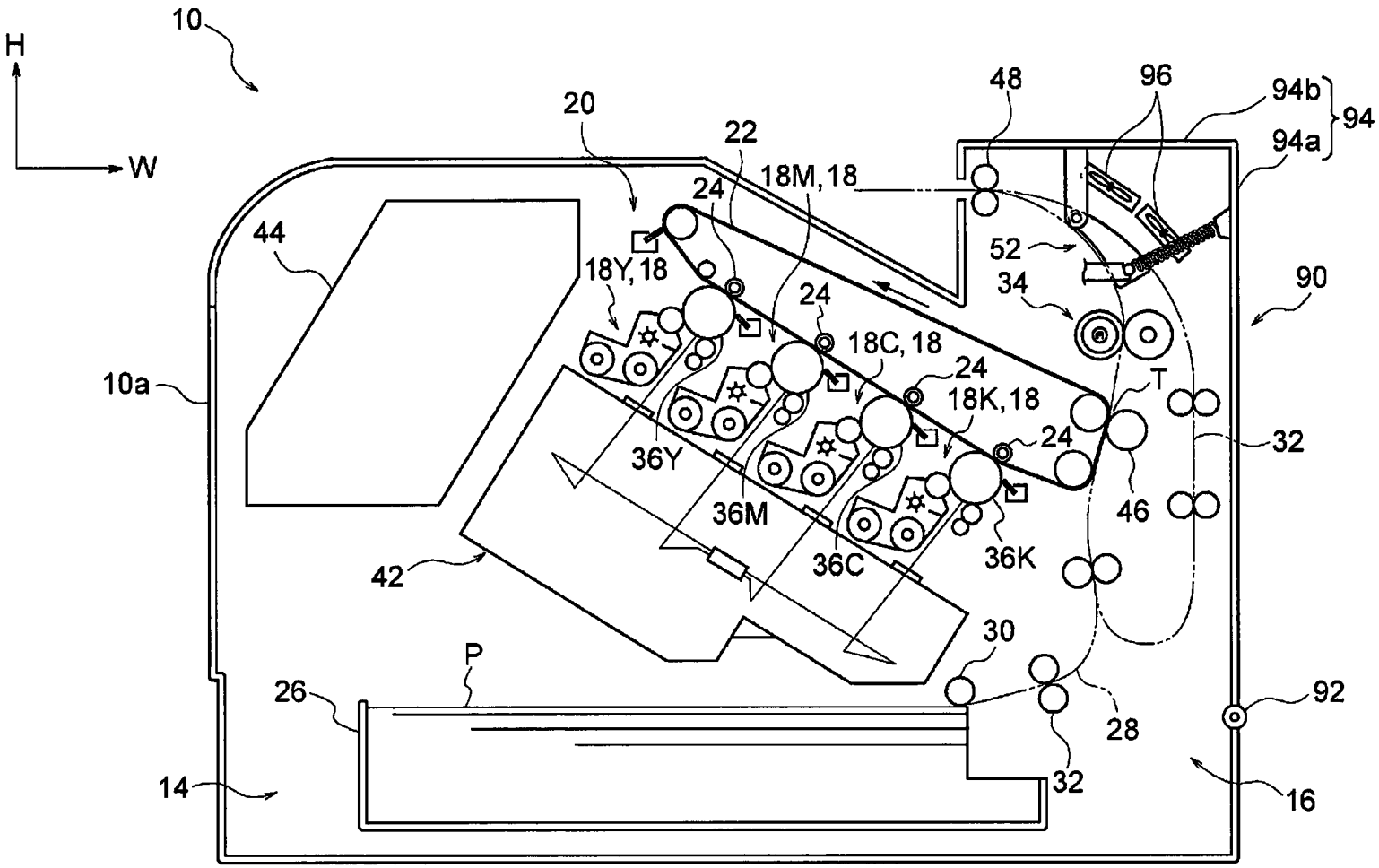
FIG. 7 is a schematic diagram illustrating the image forming apparatus according to the first exemplary embodiment of the present disclosure.

As illustrated in FIG. 7, an image forming apparatus 10 includes a storage unit 14, a transport unit 16, and an image forming section 20, which are arranged in that order from the bottom toward the top in the up-down direction. The storage unit 14 stores sheet members P, which serve as recording media. The transport unit 16 transports the sheet members P stored in the storage unit 14. The image forming section 20 forms images on the sheet members P transported from the storage unit 14 by the transport unit 16. The image forming apparatus 10 also includes a controller 44 that controls each unit.

Storage Unit

The storage unit 14 includes a storage member 26 that may be pulled forward from an apparatus body 10*a* of the image forming apparatus 10 in the apparatus depth direction. The sheet members P are stacked on the storage member 26. The storage unit 14 also includes a feed roller 30 that feeds the top sheet member P of the stack on the storage member 26 to a transport path 28, which is included in the transport unit 16.

Transport Unit

The transport unit 16 includes plural transport rollers (no reference numeral) that transport the sheet member P along the transport path 28, and a discharge roller 48 that discharges the sheet member P to the outside of the apparatus body 10*a* along the transport path 28 after a toner image is formed on the sheet member P. The transport unit 16 also includes plural transport rollers (no reference numeral) that transport the sheet member P along a reversing path 32 that reverses the sheet member P when double-sided printing is performed and when the sheet member P is transported in a switchback manner (backward) by the discharge roller 48.

The transport unit 16 also includes a guide mechanism 50 and cooling fans 96. The guide mechanism 50 guides the sheet member P toward the discharge roller 48 after the toner image is fixed to the sheet member P by a fixing device 34, which will be described below. The cooling fans 96 cool the sheet member P to which the toner image has been fixed by the fixing device 34. The guide mechanism 50, the cooling fans 96, and other members will be described in detail below.

Image Forming Section

The image forming section 20 includes four image forming units 18Y, 18M, 18C, and 18K, which are yellow (Y), magenta (M), cyan (C), and black (K) image forming units, respectively. In the following description, the characters Y, M, C, and K may be omitted when it is not necessary to distinguish between Y, M, C, and K. The image forming section 20 also includes an exposure device 42 that forms an electrostatic latent image on a surface of an image carrier 36 included in each of the image forming units 18 by irradiating the surface with exposure light.

Figure 6:
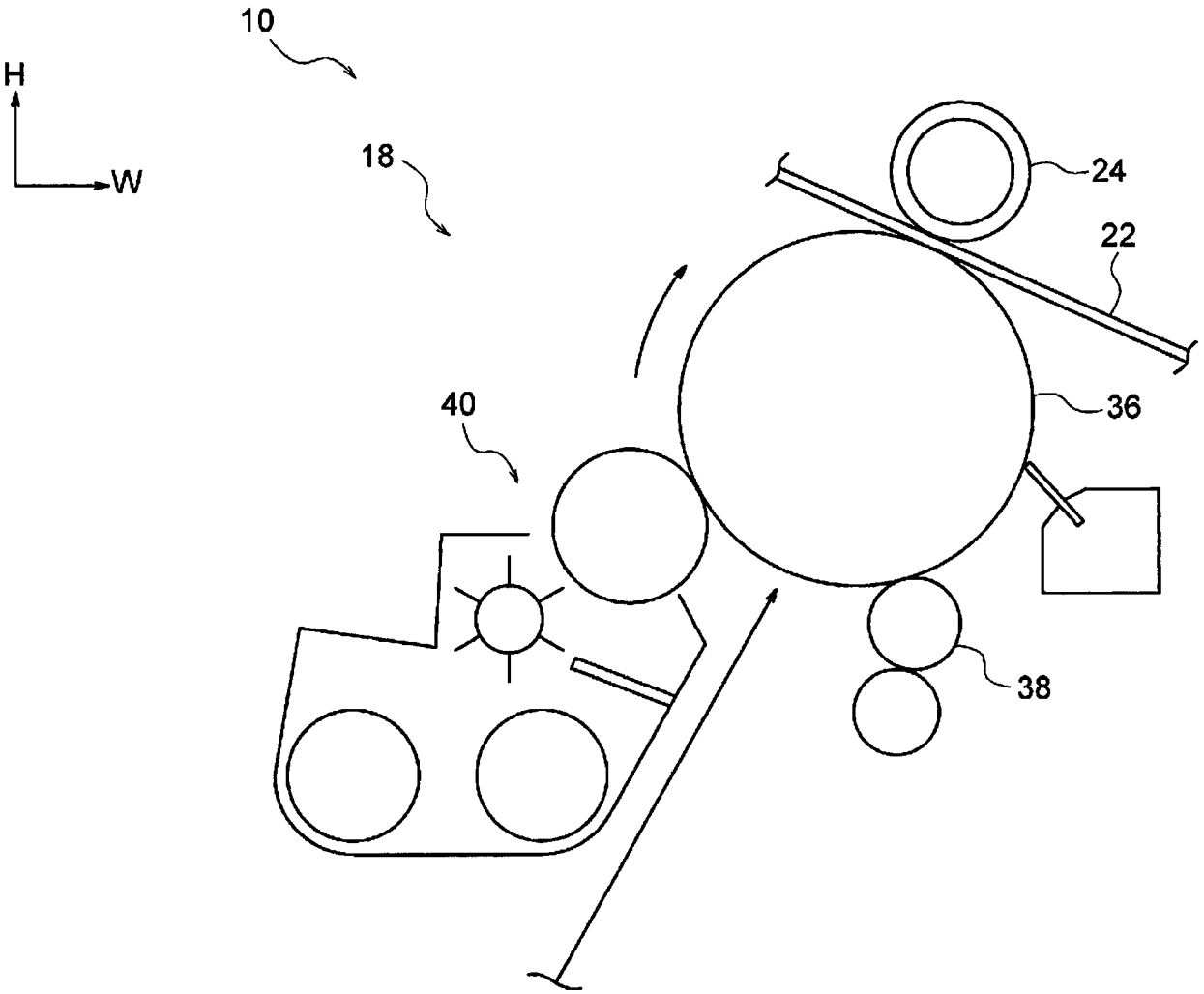
FIG. 6 illustrates an image forming unit included in the image forming apparatus according to the first exemplary embodiment of the present disclosure.

As illustrated in FIG. 6, each of the image forming units 18 of the respective colors includes the image carrier 36 that carries an image and a charging roller 38 that charges the surface of the image carrier 36. Each image forming unit 18 also includes a developing device 40 that forms a toner image by developing and visualizing the electrostatic latent image formed by the exposure device 42 (see FIG. 7) by irradiating the charged surface of the image carrier 36 with exposure light.

As illustrated in FIG. 7, the image forming section 20 also includes an endless transfer belt 22 to which the toner images formed on the image carriers 36 of the image forming units 18 of the respective colors are transferred and first transfer rollers 24 that transfer the toner images onto the transfer belt 22. The image forming section 20 also includes a second transfer roller 46 that transfers the toner images that have been transferred to the transfer belt 22 onto the sheet member P. The image forming section 20 also includes the fixing device 34 that fixes the toner image on the sheet member P to the sheet member P by heating and pressing the toner image.

As illustrated in FIG. 1, the fixing device 34 includes a heating roller 34*a* that comes into contact with an image surface of the sheet member P and heats the toner image, and a pressing roller 34*b* that nips the sheet member P together with the heating roller 34*a* and presses the sheet member P against the heating roller 34*a*. The fixing device 34 fixes the toner image to the sheet member P by nipping and transporting the sheet member P between the heating roller 34*a* and the pressing roller 34*b*.

Operation of Image Forming Apparatus

The image forming apparatus 10 illustrated in FIGS. 6 and 7 forms an image in the following manner.

First, the charging rollers 38 of the respective colors, to which a voltage is applied, come into contact with the surfaces of the image carriers 36 of the respective colors and uniformly charge the surfaces of the image carriers 36 to a predetermined negative potential. Subsequently, the exposure device 42 forms electrostatic latent images by irradiating the charged surfaces of the image carriers 36 of the respective colors with exposure light based on data input from the outside.

Thus, the electrostatic latent images corresponding to the image data are formed on the surfaces of the image carriers 36. The developing devices 40 of the respective colors develop and visualize the electrostatic latent images into toner images. The first transfer rollers 24 transfer the toner images formed on the surfaces of the image carriers 36 of the respective colors onto the transfer belt 22.

The feed roller 30 feeds the top sheet member P of the stack on the storage member 26 toward a transfer position T, at which the transfer belt 22 and the second transfer roller 46 are in contact with each other, along the transport path 28. The second transfer roller 46 and the transfer belt 22 transport the sheet member P while nipping the sheet member P therebetween at the transfer position T, so that the toner image on the transfer belt 22 is transferred onto a front surface of the sheet member P.

The fixing device 34 fixes the toner image that has been transferred to the front surface of the sheet member P to the sheet member P. The sheet member P to which the toner image is fixed is discharged to the outside of the apparatus body 10*a* by the discharge roller 48.

When the sheet member P having the toner image formed on the front surface thereof is to be subjected to an operation for forming another toner image on a back surface thereof, that is, when double-sided printing is to be performed, the discharge roller 48 transports the sheet member P in a switchback manner toward the reversing path 32 instead of discharging the sheet member P to the outside. The sheet member P that has reached the reversing path 32 is transported along the reversing path 32, and is thereby reversed and transported to the transfer position T again. The sheet member P is nipped and transported by the second transfer roller 46 and the transfer belt 22 at the transfer position T, so that a toner image on the transfer belt 22 is transferred to the back surface of the sheet member P.

The fixing device 34 fixes the toner image that has been transferred to the back surface of the sheet member P to the sheet member P. The sheet member P to which the toner image has been fixed is discharged to the outside of the apparatus body 10*a* by the discharge roller 48.

Relevant Structure

The guide mechanism 50, the cooling fans 96, and other members will now be described. The guide mechanism 50 guides the sheet member P to which the toner image has been fixed by the fixing device 34 to the discharge roller 48. The cooling fans 96 cool the sheet member P to which the toner image has been fixed.

The guide mechanism 50 and the cooling fans 96 are attached to an opening-closing door 90 that covers and exposes the inside of the apparatus body 10*a*. Positioning portions 80 that position the guide mechanism 50 are formed on the apparatus body 10*a*. The opening-closing door 90 will be described first, and then the guide mechanism 50, the positioning portions 80, and the cooling fans 96 will be described.

Opening-Closing Door 90

As illustrated in FIG. 7, the opening-closing door 90 covers and exposes the inside of the apparatus body 10*a* at one side of the apparatus body 10*a* in the apparatus width direction (side at which the fixing device 34 is disposed). More specifically, the opening-closing door 90 includes a rotating shaft 92 having an axial direction in the apparatus depth direction and a door body 94.

The door body 94 is L-shaped when viewed in the apparatus depth direction, and includes a side plate 94*a* and a top plate 94*b*. The side plate 94*a* has plate surfaces that face in the apparatus width direction, and separates the inside of the apparatus body 10*a* from the outside. The top plate 94*b* has plate surfaces that face in the apparatus up-down direction, and separates the inside of the apparatus body 10*a* from the outside.

The side plate 94*a* has a rectangular shape that extends in the apparatus up-down direction when viewed in the thickness direction thereof, and the top plate 94*b* has a rectangular shape that extends in the apparatus depth direction when viewed in the thickness direction thereof. A side edge of the top plate 94*b* is connected to the top edge of the side plate 94*a*. The rotating shaft 92 is attached to the bottom edge of the side plate 94*a*. The rotating shaft 92 is provided with a limiting mechanism that limits the amount by which the door body 94 may be opened.

Figure 5B:
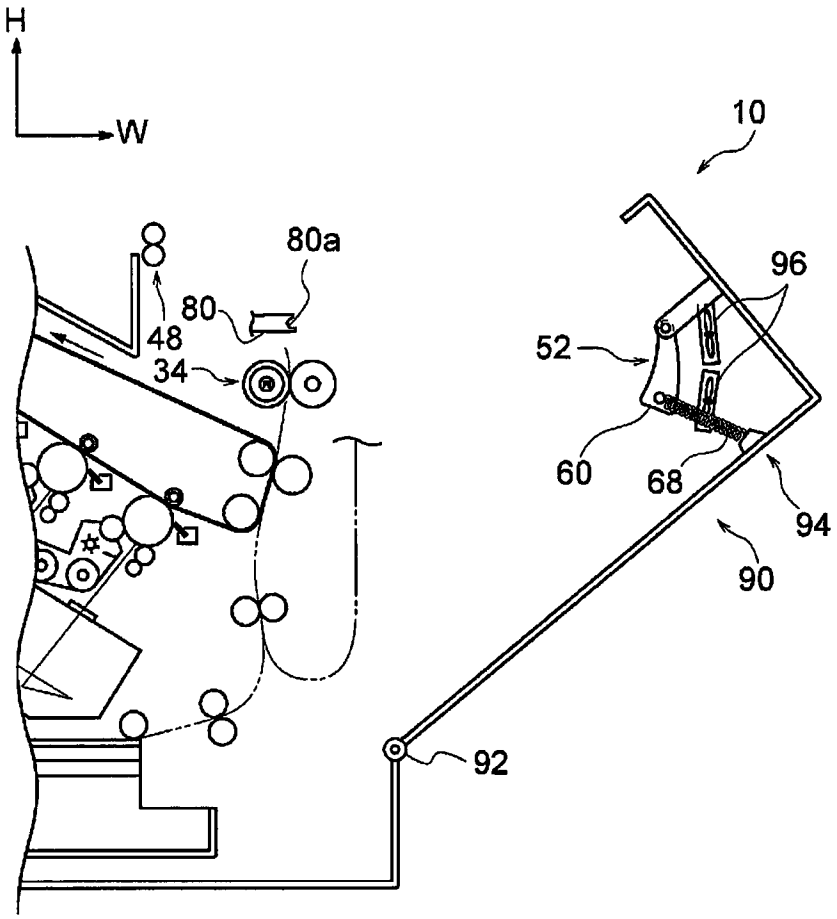
FIGS. 5A and 5B are side views illustrating the opening-closing door included in the image forming apparatus according to the first exemplary embodiment of the present disclosure at a closed position and an open position, respectively.
Figure 5A:
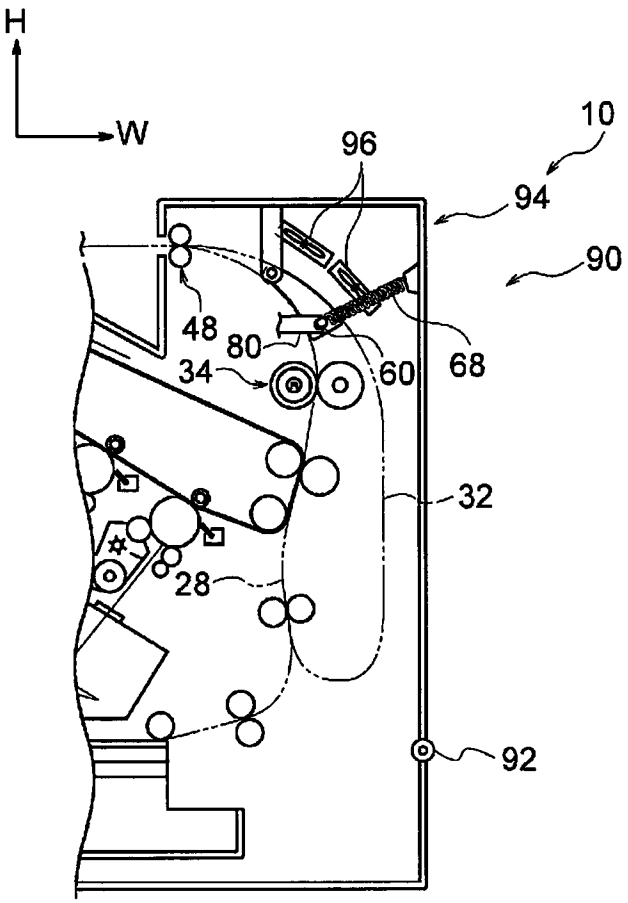

In this structure, as illustrated in FIGS. 5A and 5B, the door body 94 of the opening-closing door 90 is rotated around the rotating shaft 92 to cover and expose the inside of the apparatus body 10*a*. The opening-closing door 90 moves between a closed position (see FIG. 5A) at which the opening-closing door 90 covers the inside of the apparatus body 10*a* and an open position (see FIG. 5B) at which the opening-closing door 90 exposes the inside of the apparatus body 10*a*.

Guide Mechanism 50

As illustrated in FIG. 1, the guide mechanism 50 is disposed downstream of the fixing device 34 in a transporting direction in which the sheet member P is transported toward the discharge roller 48 (hereinafter referred to as a "sheet transporting direction". The guide mechanism 50 includes a guide member 52, a pair of support members 64 that support the guide member 52, and a pair of urging members 68.

Guide Member 52

Figure 3:
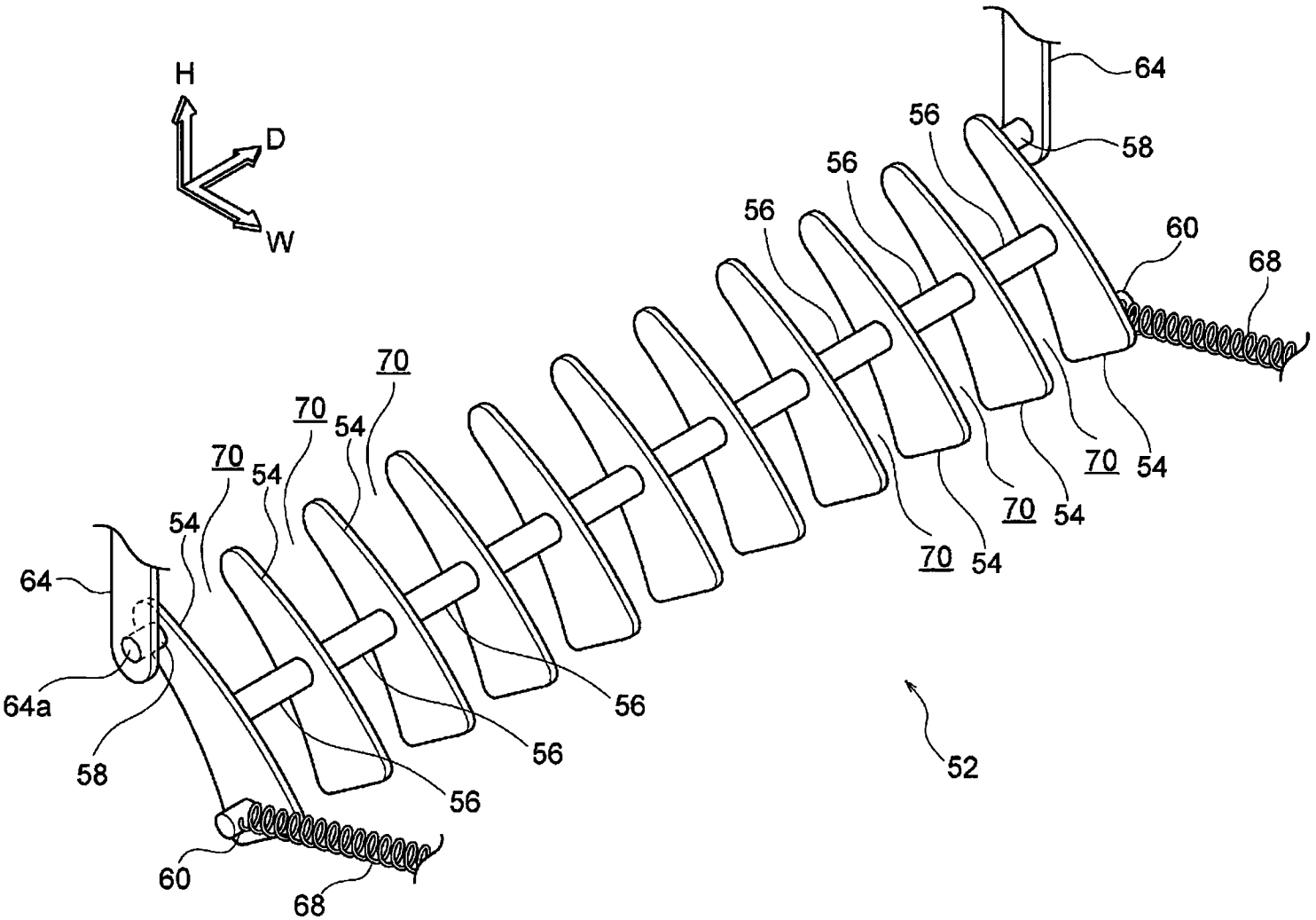
FIG. 3 is a perspective view of the guide member included in the image forming apparatus according to the first exemplary embodiment of the present disclosure.

The guide member 52 is arranged to separate the transport path 28, along which the sheet member P is transported from the fixing device 34 to the discharge roller 48, from the reversing path 32, along which the sheet member P is transported after being transported in a switchback manner (backward) by the discharge roller 48. More specifically, the guide member 52 is arranged to separate a portion of the transport path 28 that is convexly curved toward the connecting portion between the side plate 94*a* and the top plate 94*b* from a portion of the reversing path 32 that is convexly curved toward the connecting portion between the side plate 94*a* and the top plate 94*b*. As illustrated in FIG. 3, the guide member 52 includes plural guide plates 54 having plate surfaces that face in the apparatus depth direction and plural connecting portions 56 that connect the guide plates 54.

The guide plates 54 have a triangular shape that extends along the transport path 28 and the reversing path 32 (see FIG. 1). Spaces 70 are provided between the guide plates 54 that are adjacent to each other. The connecting portions 56 have a columnar shape that extends in the apparatus depth direction, and are disposed between the guide plates 54 that are adjacent to each other. One end of each connecting portion 56 is fixed to a central portion of one of the guide plates 54 in the longitudinal direction, and the other end of the connecting portion 56 is fixed to a central portion of another one of the guide plates 54 in the longitudinal direction. Thus, the connecting portions 56 connect the guide plates 54 to each other. The spaces 70 are an example of a communicating portion.

As illustrated in FIG. 1, each guide plate 54 has a first guide surface 54*a* at a side adjacent to the transport path 28. The first guide surface 54*a* is concavely curved when viewed in the apparatus depth direction. The sheet member P that is transported along the transport path 28 is guided while being in contact with the first guide surface 54*a*.

Each guide plate 54 also has a second guide surface 54*b* at a side adjacent to the reversing path 32. The second guide surface 54*b* is convexly curved when viewed in the apparatus depth direction. The sheet member P that is transported along the reversing path 32 is guided while being in contact with the second guide surface 54*b*.

In this structure, the first guide surface 54*a* of each guide plate 54 guides the sheet member P that is transported toward the discharge roller 48, and the second guide surface 54*b* of each guide plate 54 guides the sheet member P that is transported from the discharge roller 48. Thus, the guide member 52 functions as two-way guide means capable of guiding both the sheet member P transported toward the discharge roller 48 and the sheet member P transported from the discharge roller 48.

In addition, as described above, the spaces 70 are provided between the guide plates 54 that are adjacent to each other (see FIG. 3). The spaces 70 enable air to flow between the transport path 28 and the reversing path 32. Thus, the guide member 52 also functions as air ventilating means that enables air to flow between the transport path 28 and the reversing path 32. The spaces 70 also enable air to flow between a region upstream of the guide member 52 in the sheet transporting direction and a region downstream of the guide member 52 in the sheet transporting direction. Thus, the spaces 70 are also open at the upstream side of the guide member 52 in the sheet transporting direction and the downstream side of the guide member 52 in the sheet transporting direction.

The gaps between the guide plates 54 that are adjacent to each other are as large as possible to improve the function of the air ventilating means, but are as small as possible to improve the function of the two-way guide means. In consideration of these two functions, the gaps (distances) between the guide plates 54 that are adjacent to each other may be in the range from 5 mm to 40 mm, preferably in the range from 10 mm to 30 mm, and more preferably in the range from 15 mm to 25 mm.

As illustrated in FIG. 3, the guide plates 54 disposed at both ends in the apparatus depth direction have columnar portions 58 on portions thereof near the discharge roller 48. Also, the guide plates 54 disposed at both ends in the apparatus depth direction have columnar portions 60 on portions thereof far from the discharge roller 48.

Each columnar portion 58 projects outward (away from the guide plates 54) in the apparatus depth direction from the portion of the corresponding guide plate 54 that is near the discharge roller 48, and extends in the apparatus depth direction.

Each columnar portion 60 projects outward (away from the guide plates 54) in the apparatus depth direction from the portion of the corresponding guide plate 54 that is far from the discharge roller 48, and extends in the apparatus depth direction.

Support Member 64

As illustrated in FIGS. 1 and 3, the support members 64 support the guide member 52 at positions near the discharge roller 48. The pair of support members 64 extend in the apparatus up-down direction when the opening-closing door 90 is at the closed position, and are fixed to the top plate 94*b* at proximal ends thereof. The support members 64 have circular holes 64*a* through which the columnar portions 58 are rotatably inserted at distal ends thereof.

In this structure, the support members 64 support the guide member 52 such that the guide member 52 is rotatable with the columnar portions 58 serving as the rotation center.

Urging Members 68

The urging members 68 are compression coil springs that urge the guide member 52 toward the apparatus body 10*a* at positions far from the discharge roller 48, as illustrated in FIGS. 1 and 3. The pair of urging members 68 are attached to respective ones of the columnar portions 60 by attachment members (not shown) at the distal ends thereof, and are attached to respective ones of base portions 95 formed on the side plate 94*a* by attachment members (not shown) at proximal ends thereof. As illustrated in FIG. 1, when viewed in the apparatus depth direction, the direction in which a center axis L1 of each urging member 68 extends is the direction normal to each first guide surface 54*a* of the guide member 52 at an intersection dl between the center axis L1 of the urging member 68 and the first guide surface 54*a*.

Positioning Portions 80

Figure 2:
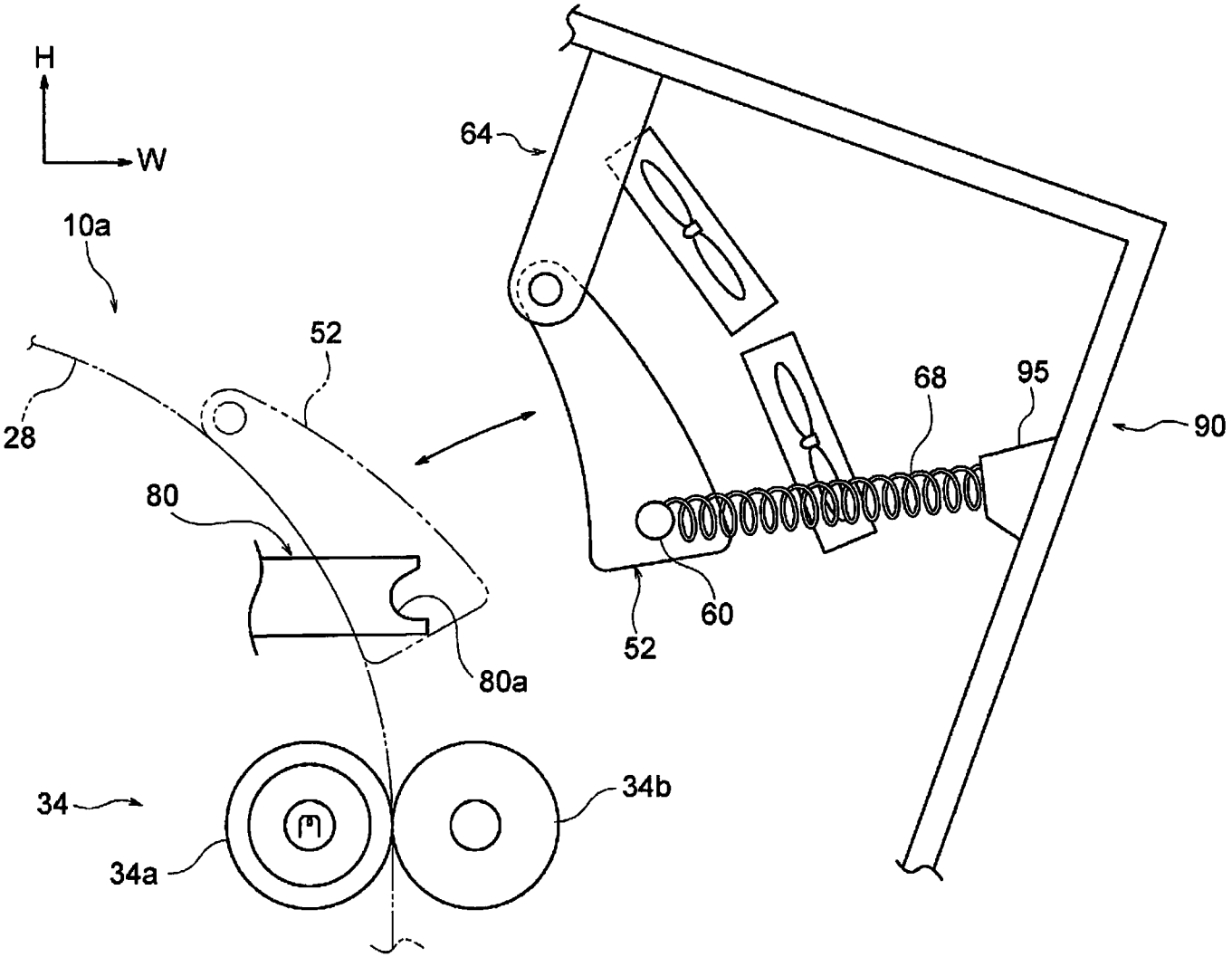
FIG. 2 is a side view illustrating the guide member, the cooling fans, and other members included in the image forming apparatus according to the first exemplary embodiment of the present disclosure when the opening-closing door is open.

The positioning portions 80, which are attached to the apparatus body 10*a*, extend in the apparatus width direction, as illustrated in FIGS. 1 and 2. Each positioning portion 80 has a U-shaped recess 80*a* that receives a corresponding one of the columnar portions 60 of the guide member 52 at a distal end thereof.

In this structure, the urging members 68 urge the columnar portions 60 of the guide member 52 against the recesses 80*a* in the positioning portions 80 when the opening-closing door 90 is at the closed position. Accordingly, the columnar portions 60 of the guide member 52 are positioned with respect to the apparatus body 10*a*. Thus, the recesses 80*a* and the urging members 68 function as positioning means for positioning the columnar portions 60 of the guide member 52 with respect to the apparatus body 10*a*.

Cooling Fans 96

The cooling fans 96, which are air suction members, are arranged to face the second guide surfaces 54*b* of the guide member 52 when viewed in the apparatus depth direction, as illustrated in FIG. 1. Each cooling fan 96 includes a rotating blade 96*a*, and is attached to the opening-closing door 90 by an attachment member. The cooling fans 96 are an example of suction members.

Figure 4:
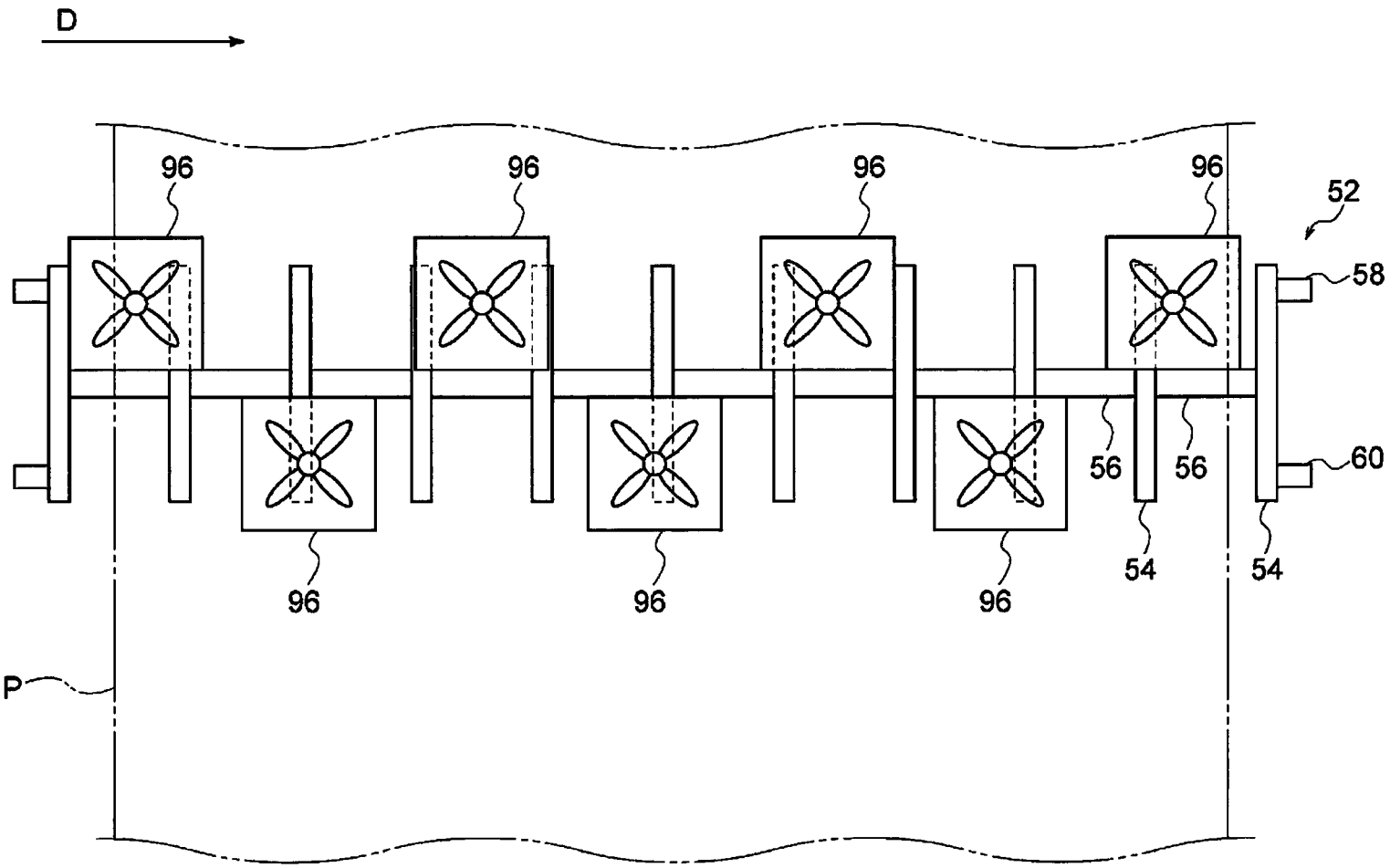
FIG. 4 illustrates the arrangement of the cooling fans and other members in the image forming apparatus according to the first exemplary embodiment of the present disclosure.

As illustrated in FIG. 4, the cooling fans 96 are aligned in the apparatus depth direction, which is the width direction of the sheet member P that is transported, and two rows of cooling fans 96 aligned in the apparatus depth direction are provided in the sheet transporting direction.

The number of cooling fans 96 in the most downstream row in the sheet transporting direction is greater than the number of cooling fans 96 in the most upstream row in the sheet transporting direction. The cooling fans 96 are arranged in a staggered pattern in the apparatus depth direction. In other words, the cooling fans 96 in the most downstream row in the sheet transporting direction and the cooling fans 96 in the most upstream row in the sheet transporting direction are at different positions in the apparatus depth direction.

As illustrated in FIG. 1, when viewed in the apparatus depth direction, the distance from the cooling fans 96 in the most downstream row in the sheet transporting direction to the first guide surfaces 54*a* is similar to the distance from the cooling fans 96 in another row (most upstream row) to the first guide surfaces 54*a*. Here, the term "similar" means that the distance from the cooling fans 96 in the most downstream row to the first guide surfaces 54*a* is within ±5% of the distance from the cooling fans 96 in another row (most upstream row) to the first guide surfaces 54*a*. When viewed in the apparatus depth direction, the distance from each cooling fan 96 to the first guide surfaces 54*a* is the distance from the cooling fan 96 to the first guide surfaces 54*a* along a rotation center line L2 of the blade 96*a* of the cooling fan 96 (G1 in FIG. 1).

When viewed in the apparatus depth direction, a suction range in which air is sucked by the cooling fans 96 extends upstream and downstream beyond the guide member 52 in the sheet transporting direction. In other words, regions in which air is sucked by the cooling fans 96 without being impeded by the guide plates 54 are provided upstream and downstream of the guide member 52 in the sheet transporting direction.

The suction range will now be described. Here, line K1 is defined as a straight line that passes through the downstream end of the rotating blade 96*a* of each cooling fan 96 in the most downstream row in the sheet transporting direction and that extends parallel to the rotation center line L2 of the blade 96*a* of each cooling fan 96 in this row. Also, line K2 is defined as a straight line that passes through the upstream end of the blade 96*a* of each cooling fan 96 in the most upstream row in the sheet transporting direction and that extends parallel to the rotation center line L2 of the blade 96*a* of each cooling fan 96 in this row. In this case, when viewed in the apparatus depth direction, a suction range H1 is defined as a range between the straight line K1 and the straight line K2.

Operation of Relevant Structure

The operation of the relevant structure will now be described.

When the image forming apparatus 10 is activated, all of the cooling fans 96 illustrated in FIG. 1 are also activated. When a toner image is transferred to the front surface of the sheet member P, the fixing device 34 heats the toner image that has been transferred to the front surface of the sheet member P while transporting the sheet member P along the transport path 28, and thereby fixes the toner image to the sheet member P. The sheet member P that is transferred by the fixing device 34 comes into contact with the first guide surfaces 54*a*, and is guided toward the discharge roller 48.

The cooling fans 96 suck air in a direction toward the reversing path 32 through the spaces 70 (see FIG. 3) between the guide plates 54 that are adjacent to each other. Accordingly, airflow is generated on the back surface of the sheet member P that is guided toward the discharge roller 48 while being in contact with the first guide surfaces 54*a*, and heat is dissipated from the sheet member P by the airflow. Thus, the cooling fans 96 cool the sheet member P.

When a toner image is to be formed only on the front surface of the sheet member P, the discharge roller 48 receives the sheet member P and discharges the sheet member P to the outside of the apparatus body 10*a*.

When a toner image is to be formed also on the back surface of the sheet member P (in the case of double-sided printing), the discharge roller 48 receives the sheet member P by rotating in one direction. Then, at the time when the trailing end of the sheet member P is separated from the guide member 52 in the sheet transporting direction, the discharge roller 48 rotates in the opposite direction. By rotating in the opposite direction, the discharge roller 48 feeds the sheet member P to the reversing path 32.

The sheet member P that is transported by the discharge roller 48 that rotates in the opposite direction comes into contact with the second guide surfaces 54*b*, and is transported along the reversing path 32. Thus, the sheet member P that is transported is reversed.

A sheet member P that is transported by the fixing device 34 may be brought into contact with the first guide surfaces 54*a* and guided along the transport path 28 while another sheet member P is in contact with the second guide surfaces 54*b* and guided along the reversing path 32. In such a case, the sheet member P that is guided along the reversing path 32 while being in contact with the second guide surfaces 54*b* serves as an obstacle that reduces the airflow generated on the back surface of the sheet member P that is guided along the transport path 28 while being in contact with the first guide surfaces 54*a*.

Summary

As described above, the sheet member P that is guided along the reversing path 32 while being in contact with the second guide surfaces 54*b* may serve as an obstacle that reduces the airflow generated on the back surface of the sheet member P that is guided along the transport path 28 while being in contact with the first guide surfaces 54*a*. However, the cooling fans 96 are aligned in two rows that are arranged in the sheet transporting direction.

Therefore, in the image forming apparatus 10, the sheet member P that is transported is cooled over a longer range in the transporting direction of the sheet member P than when only one row of cooling fans is provided in the sheet transporting direction. Since the sheet member P that is transported is cooled over a long range, the sheet member P is effectively cooled and contact marks formed on the toner image due to contact with the discharge roller 48 are reduced. In other words, the sheet member P that is transported receives suction force from the cooling fans 96 for a long time.

In addition, in the image forming apparatus 10, the cooling fans 96 in the most downstream row in the sheet transporting direction and the cooling fans 96 in the most upstream row in the sheet transporting direction are at different positions in the apparatus depth direction. Accordingly, the cooling fans 96 in the downstream row and the cooling fans 96 in the upstream row generate airflow at different positions on the back surface of the sheet member P transported along the transport path 28. Therefore, the temperature of the sheet member P is more uniform and the sheet member P that is transported is more effectively cooled than when the same number of cooling fans are provided and when the cooling fans in the most downstream row and the cooling fans in the most upstream row are at the same positions in the apparatus depth direction.

Figure 8:
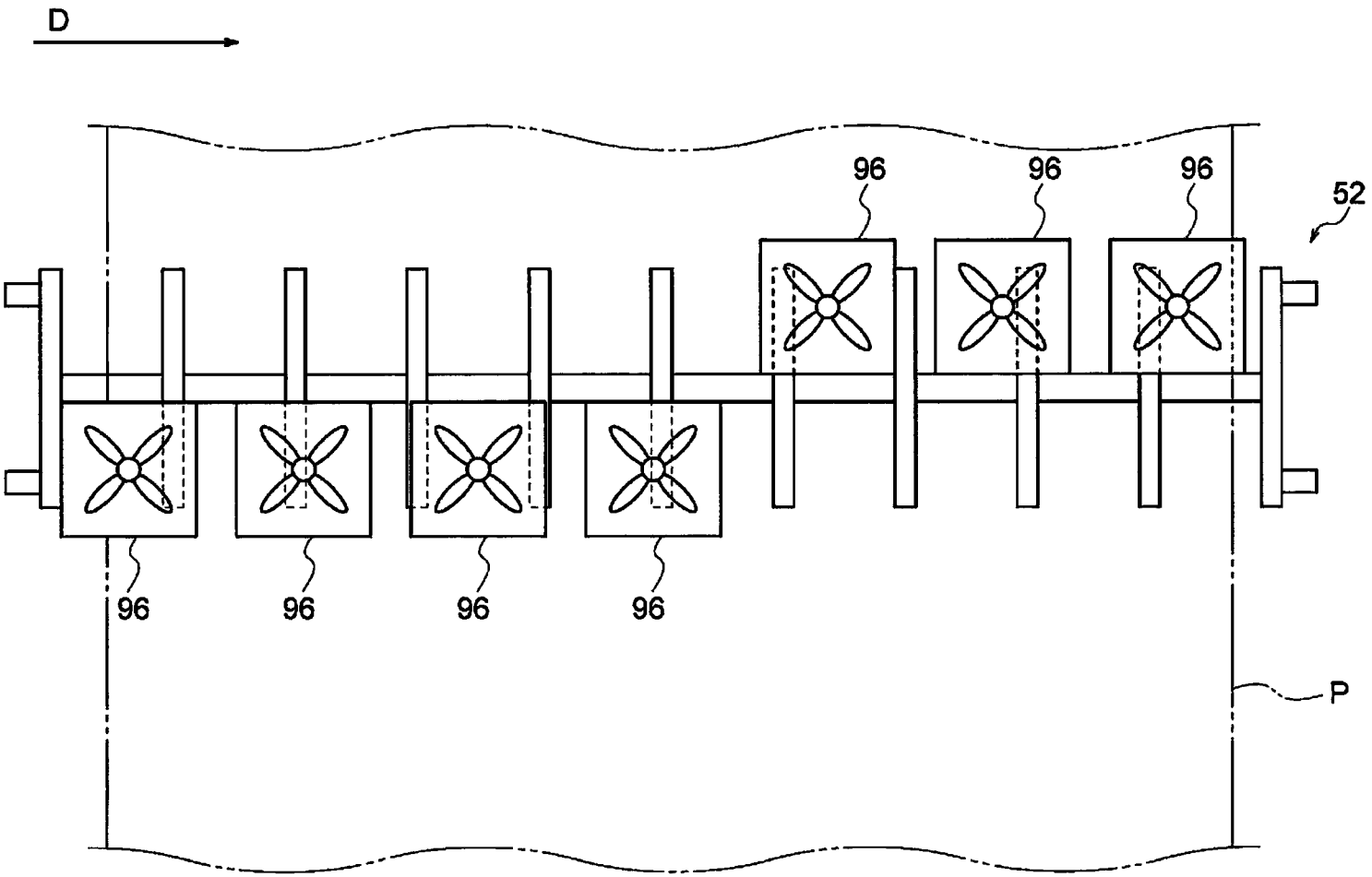
FIG. 8 illustrates the arrangement of cooling fans and other members in an image forming apparatus according to a modification of the image forming apparatus according to the first exemplary embodiment of the present disclosure.

In addition, in the image forming apparatus 10, the cooling fans 96 are arranged in a staggered pattern in the apparatus depth direction. Therefore, compared to the case in which the cooling fans 96 are arranged as illustrated in FIG. 8 such that all of the cooling fans 96 in the most downstream row in the sheet transporting direction are on one side in the apparatus depth direction with respect to all of the cooling fans 96 in the most upstream row in the sheet transporting direction, the airflow generated on the back surface of the sheet member P is more uniform (less varied) in the apparatus depth direction, and the sheet member P that is transported is more effectively cooled.

In addition, in the image forming apparatus 10, the number of cooling fans 96 in the most downstream row is greater than the number of cooling fans 96 in another row, that is, the most upstream row. Accordingly, the suction force applied by the cooling fans 96 in the downstream row to the sheet member P guided by the first guide surfaces 54*a* is greater than the suction force applied by the cooling fans 96 in the upstream row to the sheet member P guided by the first guide surfaces 54*a*. Therefore, the airflow generated on the back surface of the sheet member P in a region far from the fixing device 34 is stronger than when the number of cooling fans in the most downstream row is less than the number of cooling fans in any other row. As a result, the sheet member P that is transported is effectively cooled. The strength of the suction force may be determined based on the mass of the sheet member P retainable on the first guide surfaces 54*a* by bringing the sheet member P into contact with the first guide surfaces 54*a*.

In addition, in the image forming apparatus 10, when viewed in the apparatus depth direction, the suction range in which air is sucked by the cooling fans 96 extends upstream and downstream beyond the guide member 52 in the sheet transporting direction. In other words, regions in which air is sucked by the cooling fans 96 without being impeded by the guide plates 54 are provided upstream and downstream of the guide member 52 in the sheet transporting direction. Accordingly, the sheet member P that is transported is more effectively cooled than when the guide member extends over the entirety of the suction range when viewed in the apparatus depth direction.

Second Exemplary Embodiment

An example of an image forming apparatus according to a second exemplary embodiment of the present disclosure will now be described with reference to FIG. 9. The difference between the first and second exemplary embodiments will be basically described.

Structure

Figure 9:
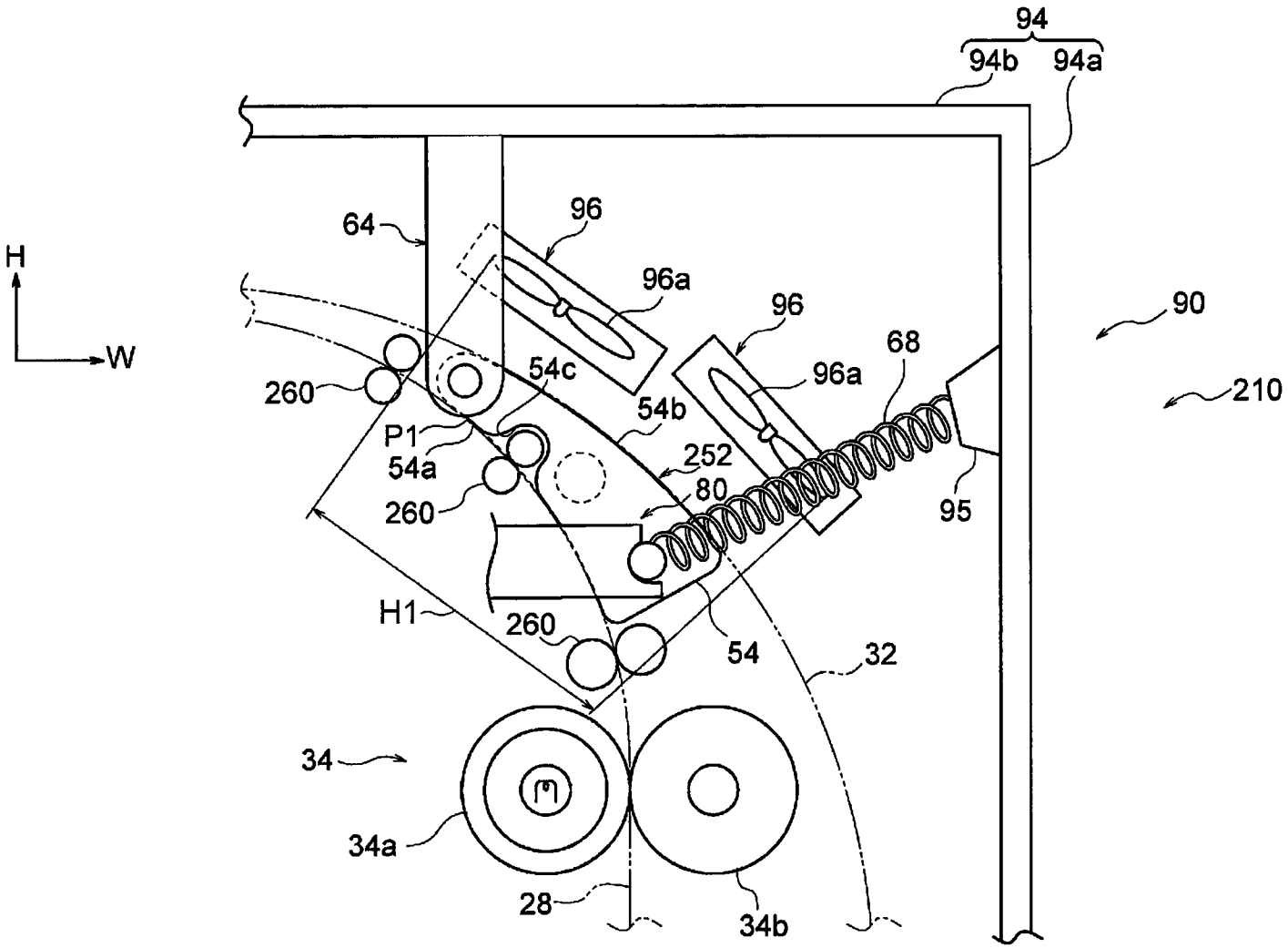
FIG. 9 is a side view illustrating a guide member, cooling fans, and other members included in an image forming apparatus according to a second exemplary embodiment of the present disclosure when an opening-closing door is closed.

As illustrated in FIG. 9, an image forming apparatus 210 according to the second exemplary embodiment is configured such that the positions of the cooling fans 96 in the most downstream row in the sheet transporting direction differ from those in the first exemplary embodiment. More specifically, when viewed in the apparatus depth direction, the distance from the cooling fans 96 in the most downstream row in the sheet transporting direction to the first guide surfaces 54*a* is less than the distance from the cooling fans 96 in another row (most upstream row) to the first guide surfaces 54*a*.

In addition, the image forming apparatus 210 includes a guide member 252 including guide plates 54 which each have a first guide surface 54*a* in which a recess 54*c* is formed. Transport rollers 260 that transport the sheet member P along the transport path 28 are disposed upstream of the first guide surfaces 54*a*, downstream of the first guide surfaces 54*a*, and in the recesses 54*c* in the guide plates 54 along the transport path 28.

When viewed in the apparatus depth direction, a suction range H1 of the cooling fans 96 is larger than an area occupied by a smallest sheet member P1 (see FIG. 9) that is guided by the first guide surfaces 54*a*. The smallest sheet member P1 is a sheet member P1 having a smallest size on which an image may be formed by the image forming apparatus 210. The smallest size is specified in the instruction manual for the image forming apparatus 210.

Summary

As described above, when viewed in the apparatus depth direction, the distance from the cooling fans 96 in the most downstream row to the first guide surfaces 54*a* is less than the distance from the cooling fans 96 in another row (most upstream row) to the first guide surfaces 54*a*. Accordingly, the suction force applied by the cooling fans 96 in the downstream row to the sheet member P guided by the first guide surfaces 54*a* is greater than the suction force applied by the cooling fans 96 in the upstream row to the sheet member P guided by the first guide surfaces 54*a*. Also, the airflow generated on the back surface of the sheet member P in a region far from the fixing device 34 is stronger than when the distance from the cooling fans in the most downstream row to the first guide surfaces is greater than the distance from the cooling fans in another row to the first guide surfaces when viewed in the apparatus depth direction. As a result, the sheet member P that is transported is effectively cooled.

In addition, when viewed in the apparatus depth direction, the suction range H1 of the cooling fans 96 is larger than the area occupied by the smallest sheet member P1 (see FIG. 9) that is guided by the first guide surfaces 54*a*. Therefore, in the case where no sheet member P is guided by the second guide surfaces 54*b* of the guide member 252, the smallest sheet member P1 that is transported is more effectively cooled than when the suction range H1 is smaller than the area occupied by the smallest sheet member P1 that is guided by the first guide surfaces when viewed in the apparatus depth direction.

Although specific exemplary embodiments of the present disclosure are described in detail above, the present disclosure is not limited by the above-described exemplary embodiments, and it is obvious to those skilled in the art that various exemplary embodiments are possible within the scope of the present disclosure. For example, although two rows of cooling fans are provided in the sheet transporting direction in the above-described first and second exemplary embodiments, three or more rows of cooling fans may instead be provided as long as the sheet member P that is transported may be cooled over a longer range than when only one row of cooling fans is provided.

In addition, in the first and second exemplary embodiments, the cooling fans 96 in the most downstream row in the sheet transporting direction and the cooling fans 96 in the most upstream row in the sheet transporting direction are at different positions in the apparatus depth direction. However, in the case where the sheet member P is heated to a high temperature in a specific region (for example, a central region in the width direction), the cooling fans in the most downstream rows in this region and the cooling fans in the most upstream row in this region may be disposed at similar positions in the apparatus depth direction to effectively cool the sheet member P in this region.

In addition, although the cooling fans 96 are arranged in a staggered pattern in the apparatus depth direction in the first and second exemplary embodiments, the cooling fans 96 may be arranged in a pattern other than a staggered pattern. However, in such a case, the effect of the arrangement in a staggered pattern cannot be obtained.

In addition, in the first and second exemplary embodiments, the number of cooling fans 96 in the most downstream row in the sheet transporting direction is greater than the number of cooling fans 96 in any other row. However, the number of cooling fans in the downstream row may instead be less than the number of cooling fans in any other row. In such a case, for example, the rotational speed of the cooling fans in the most downstream row may be increased to effectively cool the sheet member P.

In addition, although not described in the first and second exemplary embodiments, the cooling fans in the most downstream row in the sheet transporting direction and the cooling fans in the most upstream row in the sheet transporting direction may overlap in the sheet transporting direction.

In addition, although plural cooling fans 96 are arranged in the apparatus depth direction in above-described first and second exemplary embodiments, the number of cooling fans 96 arranged in the apparatus depth direction may instead be one.

The foregoing description of the exemplary embodiments of the present disclosure has been provided for the purposes of illustration and description. It is not intended to be exhaustive or to limit the disclosure to the precise forms disclosed. Obviously, many modifications and variations will be apparent to practitioners skilled in the art. The embodiments were chosen and described in order to best explain the principles of the disclosure and its practical applications, thereby enabling others skilled in the art to understand the disclosure for various embodiments and with the various modifications as are suited to the particular use contemplated. It is intended that the scope of the disclosure be defined by the following claims and their equivalents.

What is claimed is:

1. An image forming apparatus comprising:

a fixing device that fixes an image to a recording medium that is transported by applying heat;

a guide member including a first guide surface that guides the recording medium to which the image has been fixed by the fixing device, a second guide surface that is opposite to the first guide surface and that guides the recording medium that is transported backward after being guided by the first guide surface, and a communicating portion that enables air to flow between the first guide surface and the second guide surface; and a plurality of suction members that cool the recording medium guided by the first guide surface by sucking air in a direction toward the second guide surface of the guide member, the suction members being arranged in a transporting direction in which the recording medium is transported, wherein a suction force applied by the suction members in a most downstream row in the transporting direction to the recording medium guided by the first guide surface is greater than a suction force applied by the suction members in any other row to the recording medium guided by the first guide surface.

2. The image forming apparatus according to claim 1, wherein one of the suction members that is located most downstream in the transporting direction and one of the suction members that is located most upstream in the transporting direction are at different positions in a width direction of the recording medium that is transported.

3. The image forming apparatus according to claim 1, wherein, when viewed in a width direction of the recording medium that is transported, a distance from the suction members in the most downstream row in the transporting direction to the first guide surface is less than a distance from the suction members in any other row to the first guide surface.

4. The image forming apparatus according to claim 1, wherein the suction members in the most downstream row in the transporting direction are greater in number than the suction members in any other row.

5. The image forming apparatus according to claim 1, wherein, when viewed in a width direction of the recording medium that is transported, a suction range in which air is sucked by the suction members extends upstream and downstream beyond the guide member in the transporting direction.

6. The image forming apparatus according to claim 1, wherein, when viewed in a width direction of the recording medium that is transported, a suction range in which air is sucked by the suction members is larger than an area occupied by a smallest recording medium that is guided by the first guide surface.

7. An image forming apparatus comprising:

a fixing device that fixes an image to a recording medium that is transported by applying heat;

a guide member including a first guide surface that guides the recording medium to which the image has been fixed by the fixing device, a second guide surface that is opposite to the first guide surface and that guides the recording medium that is transported backward after being guided by the first guide surface, and a communicating portion that enables air to flow between the first guide surface and the second guide surface; and a plurality of suction members that cool the recording medium guided by the first guide surface by sucking air in a direction toward the second guide surface of the guide member, the suction members being arranged in a transporting direction in which the recording medium is transported, wherein one of the suction members that is located most downstream in the transporting direction and one of the suction members that is located most upstream in the transporting direction are at different positions in a width direction of the recording medium that is transported, wherein the suction members are aligned in the width direction, and two rows of the suction members aligned in the width direction are provided in the transporting direction of the recording medium, and wherein the suction members in a downstream one of the two rows in the transporting direction and the suction members in an upstream one of the two rows in the transporting direction are arranged in a staggered pattern in the width direction.

* * * * *